US006696799B2

(12) United States Patent
Vukosic

(10) Patent No.: US 6,696,799 B2
(45) Date of Patent: Feb. 24, 2004

(54) DIAGNOSTIC SYSTEM FOR A STROBE LAMP AND ITS OPERATING CIRCUIT

(75) Inventor: Stephen T. Vukosic, Rochester, NY (US)

(73) Assignee: Star Headlight and Lantern Co., Inc., Avon, NY (US)

( * ) Notice: Subject to any disclaimer, the term of this patent is extended or adjusted under 35 U.S.C. 154(b) by 0 days.

(21) Appl. No.: 10/131,981

(22) Filed: Apr. 25, 2002

(65) Prior Publication Data

US 2003/0201730 A1 Oct. 30, 2003

(51) Int. Cl.[7] ..... H05B 37/00
(52) U.S. Cl. ..... 315/241 S; 396/206
(58) Field of Search ..... 315/241 S, 241 P, 315/241 R, 307, 76, 77, 209 CD; 363/15; 396/206, 205; H05B 37/00

(56) References Cited

U.S. PATENT DOCUMENTS

| | | | | | |
|---|---|---|---|---|---|
| 3,626,401 | A | | 12/1971 | Flieder et al. | 340/253 |
| 4,318,031 | A | | 3/1982 | Lonseth et al. | 315/133 |
| 4,330,737 | A | * | 5/1982 | Orban | 315/241 P |
| 4,354,181 | A | | 10/1982 | Spletzer | 340/642 |
| 4,667,187 | A | | 5/1987 | Volk et al. | 340/641 |
| 4,712,051 | A | | 12/1987 | Fathi | 318/564 |
| 4,924,149 | A | * | 5/1990 | Nishida et al. | 315/241 P |
| 5,151,631 | A | | 9/1992 | Oda et al. | 315/127 |
| 5,442,257 | A | | 8/1995 | Mitsumoto | 315/129 |
| 5,515,028 | A | | 5/1996 | Dittmar | 340/458 |
| 5,663,711 | A | | 9/1997 | Sanders et al. | 340/635 |
| 5,699,051 | A | | 12/1997 | Billig et al. | 340/657 |
| 5,801,623 | A | | 9/1998 | Chen et al. | 340/458 |
| 5,811,975 | A | | 9/1998 | Bernardo | 324/414 |
| 6,034,486 | A | * | 3/2000 | Fukui | 315/241 P |
| 6,066,926 | A | * | 5/2000 | Yamada | 315/241 P |
| 6,127,782 | A | | 10/2000 | Flory, IV et al. | 315/129 |
| 6,140,926 | A | | 10/2000 | Hayden et al. | 340/635 |
| 6,147,460 | A | * | 11/2000 | Ichihara | 315/241 P |
| 6,154,122 | A | | 11/2000 | Menze | 340/425.5 |
| 6,323,759 | B1 | | 11/2001 | Menze | 340/425.5 |
| 6,400,277 | B2 | | 6/2002 | Guedes | 340/646 |
| 6,407,512 | B1 | * | 6/2002 | Yoshida et al. | 315/241 P |
| 6,476,564 | B1 | * | 11/2002 | Tsuchida | 315/241 P |
| 6,483,439 | B1 | | 11/2002 | Vukosic | 340/815.65 |
| 2002/0163438 | A1 | | 11/2002 | Kuhr et al. | |

OTHER PUBLICATIONS

6900 Series Strobe Beacons, Installation and Operation Manual, ECCO Electronics Controls Co., 2002.
ECCO 30th Anniversary Product Guide, ECCO Electronics Controls Co., p. 12, 2002.

* cited by examiner

*Primary Examiner*—Don Wong
*Assistant Examiner*—Trinh Vo Dinh
(74) *Attorney, Agent, or Firm*—Kenneth J. Lukacher; Martin Lukacher

(57) ABSTRACT

In order to diagnose a strobe lamp system in a manner to isolate failure (burn out) of the strobe lamp from failures in its operating circuits, particularly the DC-DC converter which provides operating voltage to the lamp, a microcontroller, which produces sequences of signals corresponding to sequences of flashes from the lamp, is programmed so that the sequences of signals are not produced in the absence of output voltage from the DC-DC converter. The microcontroller is connected via a circuit including an LED to the circuit which converts the signals into trigger pulses for the strobe lamp. The failure of the strobe lamp to flash while the LED flashes isolates failures to the DC-DC converter, whereas flashing of the LED alone isolates failure to the lamp.

11 Claims, 2 Drawing Sheets

DIAGNOSTIC SYSTEM FOR A STROBE LAMP AND ITS OPERATING CIRCUIT

DESCRIPTION

Figure 1:
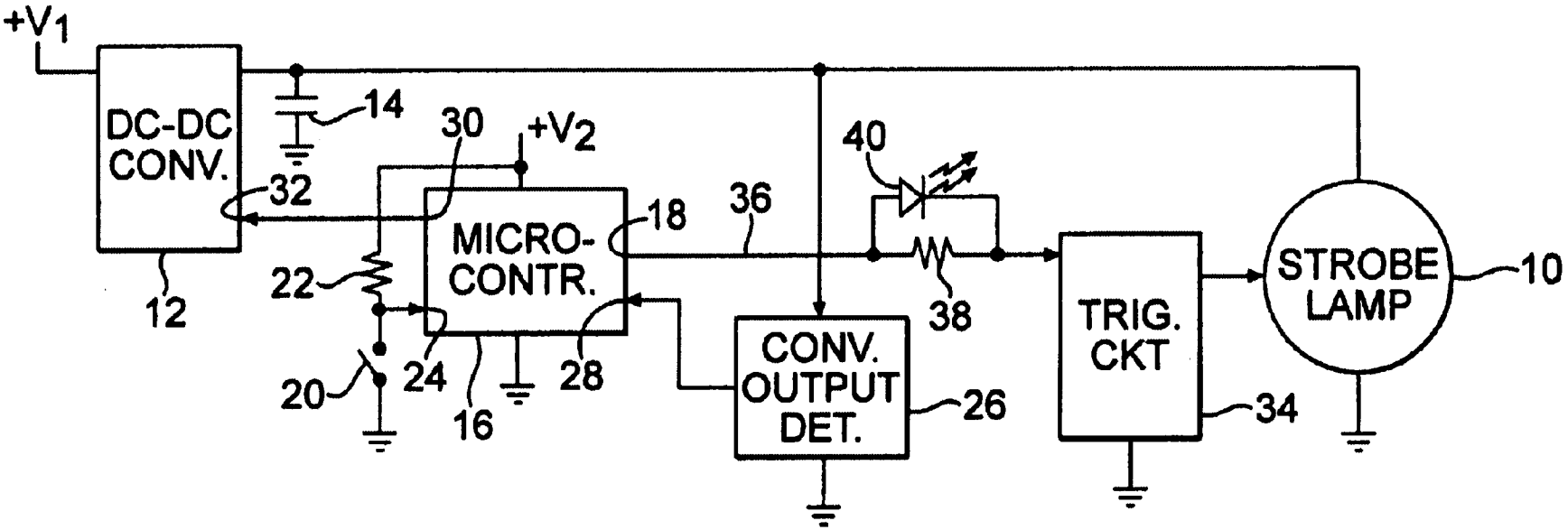

The present invention relates to diagnostic systems for strobe lamps and their operating circuits and provides a display which enables discrimination between failures of the strobe lamp and of its operating circuit; thus, making maintenance of strobe lamp apparatus efficient, since the entire strobe lamp unit need not be removed for maintenance when the lamp burns and the apparatus can be repaired by replacing the lamp alone.

Strobe lamps are usually installed in locations difficult to reach, such as the roof of a vehicle or on a pole at the top of the vehicle or a machine. When the strobe lamp fails; it is desirable, for efficient maintenance, to know whether only the lamp needs replacement or the entire apparatus needs to be removed for repair.

Heretofore systems for detecting failures have merely indicated the absence of power for driving the strobe lamp. This can be due to the strobe lamp burnout, circuit failure, or loss of power to system. The DC-DC converter of the operating circuit which is used to develop high voltage for the lamp is especially prone to failure. Thus, the maintenance procedures for fixing the strobe unit have required the removal and examination of the entire unit including the operating circuit, the lamp in its socket and the enclosure. It is frustrating and inefficient to remove and replace the lamp (especially when access thereto is difficult) and then to find that the lamp has not failed. Then the entire unit must be removed once diagnosed for failures.

The present invention enables diagnosis without removal of the entire strobe lamp unit. The invention enables maintenance personnel to know whether the lamp failed or the circuit failed and isolates failures to the DC-DC converter. It is a feature of the invention to incorporate the diagnosing facility using circuitry of the strobe lamp unit itself. This failure mode detection facility is provided without redesign of the operating circuit. The principal modification is the addition of an indicator which may be a simple LED (light emitting device) component and programming of the microcontroller which selects the light pulse pattern which the strobe lamp is adapted to emit.

Accordingly, it is the object of the present invention to provide a system for the diagnosis of a strobe lamp unit including the lamp and its operating circuit which discriminates between failures of the lamp and the operating circuit.

Another object of the invention is to provide such a strobe lamp diagnosis facility without redesign of the strobe lamp system and through the use of the circuits within the strobe lamp system itself.

Briefly described, a diagnostic system for a strobe lamp in accordance with the invention utilizes means for detecting when the operating circuit, especially the DC-DC converter thereof, provides voltage to the lamp. Means for example including the microcontroller of the operating circuit which transmits trigger pulses for flashing the lamp is controlled in response to the presence or absence of the operating voltage to the lamp and is programmed so that in the absence of operating voltage the trigger pulses are not produced. Transmission of the pulses from the microcontroller is used to operate a display, which may be implemented by a LED connected in the path of the trigger pulses (for example, in series in the path or in parallel with the path), so that the LED displays (flashes) whether or not the lamp is operational. Failures of the lamp or the operating circuit are isolated since when the trigger pulses are displayed and the lamp does not flash, the burnout of the lamp is indicated; but when the trigger pulses are not displayed and the lamp does not flash failure of the operating circuit is indicated. The diagnostic system is implemented by programming the microcontroller (the device) which generates and transmits the pulses which are used to generate triggers for the strobe lamp, and by the addition of a simple display device, such as the LED.

Figure 2:
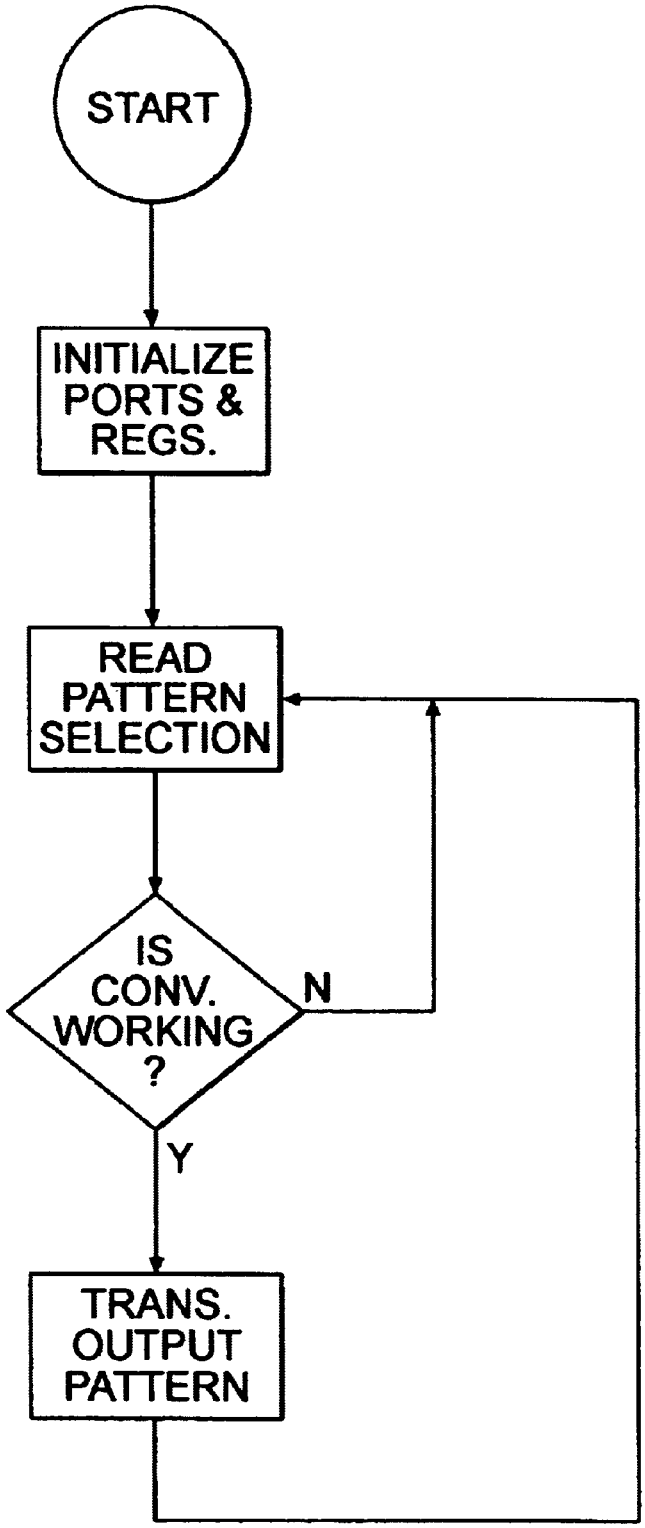

The foregoing and other objects, features, and advantages of the invention will become more apparent from a reading of the following description when taken in connection with the accompanying drawings wherein:

FIG. 1 is a block diagram illustrating a diagnostic system for strobe lamps and their operating circuits, in accordance with the invention; and FIG. 2 is flow chart indicating the programming of the microcontroller of the circuit shown in FIG. 1 so as to enable isolation of failure modes between the lamp and its operating circuit.

Referring first to FIG. 1 there is shown a strobe lamp 10 to which operating voltage is applied, for example of about 400 volts DC from a DC-DC converter 12 which converts power from a separate power supply or battery at a lower voltage V1 than is applied to the lamp 10. V1 maybe about 12 volts DC. The voltage applied to lamp 10 appears as a charge on a capacitor 14 and the output of the converter is connected to the strobe lamp.

A microcontroller, suitably a type PIC12C508 is powered by operating voltage V2, suitably about 5 volts. This microcontroller has registers which are preprogrammed to establish sequences or patterns of output signals in the form of pulses at an output port 18. There may be a plurality, such as two, patterns or sequences which are selectable by a switch or jumper 20, which when closed completes a circuit through a resistor 22 so as to present an enable level to an input port 24.

The microcontroller 16 has additional input from a converter output voltage detector 26. The detector may be an analog circuit such as includes a voltage divider which applies a level (or signals) corresponding to the output voltage of converter 12 to a microcontroller input port 28. The detector 26 may alternatively be a circuit which digitizes the output voltage at the output of the converter and provides a logic level (or signals) at the port 28 indicative of whether the DC-DC converter is producing an output voltage or not.

Another output port 30 of the microcontroller 16 is connected to an input control port 32 of the DC-DC converter 12. The output from the port 30 inhibits the converter from increasing the charge so that voltage across the capacitor 14 becomes excessive for the circuit components in use, when a pattern or sequence of output pulses is being generated at output port 18 of the microcontroller 16.

High voltage pulses for triggering the strobe lamp 10 are generated in a trigger circuit 34 which connected to the output port 18 of the microcontroller 16 via a connection 36 through a resistor 38. A light emitting device, preferably an LED 40, is connected across the resistor 38. This LED will illuminate or flash in accordance with the pattern (the sequence of signals) generated by the microcontroller. The trigger circuit 34 may include a transformer and a pulse generator which passes pulses through the transformer so that they are stepped up in voltage to a trigger voltage, which may be about 4,000 volts, for triggering the strobe lamp.

Some or all of trigger circuit 34 may also be incorporated into strobe lamp assembly, especially when strobe lamp mounting is to be remote from power supply.

The LED 40 provides a display for diagnosing whether the operating circuit, particularly the DC-DC converter 12 thereof, or the strobe lamp 10 has failed. This facility is provided by programming the microcontroller 18.

The programming of the microcontroller is illustrated in FIG. 2. Upon connection of the operating voltages V1 and V2 the program is started. The first step is to initialize the microcontroller ports and registers therein. The selected pattern (the selection being made with the jumper switch 20) is then read. The detector 26 input at the port 28 is then considered by the program to determine whether the converter 12 is working. This decision step is used to enable the microcontroller, if the converter is working, to transmit the output pattern across the connection 36 and to illuminate the LED 40. The LED 40 is illuminated regardless of whether the strobe lamp has failed or has not failed. If the converter is not working, the program loops to the read pattern selection pattern step and continues to test the operating circuit.

The operating circuit and the lamp may be part of the strobe lamp unit. The lamp is visible from the housing, usually through the lens of the strobe lamp. The operator then is provided a display from the LED 40, which when flashing (or flashes at such a rate that the LED 40 appears illuminated to the operator) indicates that the operating circuit is working. Normally, the LED 40 is flashing to indicate that the lamp's operating circuit is functional. Thus, if the strobe lamp is then not working (i.e., does not flash) and the LED 40 is flashing, the operator is assured that the strobe lamp has failed and should be replaced. However, if the strobe lamp is not working and the LED 40 does not flash, the failure is in the operating circuit and particularly the DC-DC converter thereof which is the most failure prone component of the circuit. Then the entire unit may be removed and serviced so as to repair or replace the converter. Maintenance operations are thereby facilitated since the maintenance operator has been given the facility for diagnosing failures in a manner to isolate the two most likely modes before the necessity of removing the entire unit from its installed location, such as the top of a vehicle or a pole, arises.

From the foregoing description it will be apparent that there has been provided an improved diagnostic system for strobe lamps and their operating circuits. Variations and modifications in the herein described system including programming modifications and circuit modifications, within the scope of the invention, will undoubtedly suggest themselves to those skilled in the art. Accordingly, the foregoing description should be taken as illustrative and not in the limiting sense.

What is claimed is:

1. A diagnostic system for a strobe lamp which flashes when a pulsed voltage is applied thereto from an operating circuit, said system comprising means for detecting when said operating circuit provides said voltage means for transmitting trigger pulses for flashing said lamp when said detecting means detects the provision of said voltage, and means for displaying the transmission of said trigger pulses to said lamp irrespective of whether of said lamp is operational thereby isolating failures to said lamp or said operating circuit, respectively, when said trigger pulses are displayed and said lamp does not flash and when said trigger pulses are not displayed and said lamp does not flash.

2. The system of claim 1 wherein said transmitting means comprises means for generating signals corresponding to desired patterns of flashing of said lamp, and means for inhibiting the generating of said signals in response to said detecting means when said detecting means fails to detect the operating voltage.

3. The system of claim 1 wherein said displaying means comprises a circuit carrying pulses for triggering said strobe lamp, an optical display device provided by an LED connected to said circuit carrying said pulses and illuminated in response to said pulses.

4. The system of claim 2 further comprising a circuit which carries said signals generated by said generating means, and said display means comprising a lamp provided by an LED connected to said circuit which carries said signals and is illuminated in response to said signals.

5. The system of claim 1 wherein said transmitting means comprises a microcontroller programmed to produce a sequence of signals corresponding to flashes desired from said strobe lamp, a DC-DC converter in said operating circuit for producing said voltage at an output connected to said lamp, said detecting means comprising means connected to said output for providing an input to said microcontroller indicative of the presence or absence of said voltage at said output, said microcontroller being programmed to respond to said input to produce said sequence of signals only if said input is indicative of the presence of said voltage at said output.

6. The system of claim 5 wherein said transmitting means includes a trigger circuit responsive to said signals for translating said signals into trigger pulses and applying said trigger pulses to said strobe lamp, and a connection between said microcontroller and said trigger circuit via which said signals are carried, and said displaying means comprising a light emitting device connected to said trigger circuit and illuminated by said signals if and when produced by said microcontroller.

7. The system of claim 6 wherein said connection includes a resistor and an LED connected across said resistor, said LED providing said light emitting device.

8. A diagnostic system for a strobe lamp comprising:

a controller for controlling the operation of said lamp;

a capacitor;

a converter for converting a first voltage to a second voltage sufficient for charging said capacitor to a voltage for operating said lamp;

a trigger circuit operating responsive to signals from said controller to trigger operation of said lamp by said charged capacitor;

a detector circuit for detecting the second voltage of said converter and providing signals representative of the detected voltage to said controller; and a light source which receives the signals sent to said trigger circuit from said controller and operates responsive to said signals, in which said controller disables said signals to said trigger circuit when said signals from said detector circuit indicate that said converter is not providing said second voltage.

9. The system of claim 8 wherein said light source is an LED.

10. The system of claim 8 wherein said controller disables said converter when said detector circuit indicates that said converter is not providing said second voltage.

11. A method for diagnosing failure of a strobe lamp which flashes when pulsed and voltage is applied thereto from an operating circuit, said method comprising the steps of:

detecting when said operating circuit provides voltage to said lamp;

transmitting trigger pulses for flashing said lamp when said voltage is detected; and displaying the transmission of said trigger pulses to said lamp to indicate operation of said operating circuit irrespective of whether said lamp is operational, in which when transmission of said trigger pulses are displayed and said lamp is not flashing, failure of said lamp is indicated.

* * * * *